US008650848B2

(12) United States Patent
Guggemos et al.

(10) Patent No.: US 8,650,848 B2
(45) Date of Patent: Feb. 18, 2014

(54) MULTI-STATION TEXTILE MACHINE, IN PARTICULAR TWO-FOR-ONE TWISTING OR CABLING MACHINE

(71) Applicant: Oerlikon Textile GmbH & Co. KG., Remscheid (DE)

(72) Inventors: Hans Guggemos, Oy-Mittelberg-Petersthal (DE); Walter Pede-Vogler, Durach (DE); Alexander Thaler, Burggen (DE); Manuel Wolfle, Kempten (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 13/623,236

(22) Filed: Sep. 20, 2012

(65) Prior Publication Data

US 2013/0074468 A1 Mar. 28, 2013

(30) Foreign Application Priority Data

Sep. 22, 2011 (DE) ..... 10 2011 113 883

(51) Int. Cl.
*D01H 1/10* (2006.01)

(52) U.S. Cl.
USPC ..... 57/58.49; 57/136

(58) Field of Classification Search
USPC ..... 57/58.49, 136
See application file for complete search history.

(56) References Cited

U.S. PATENT DOCUMENTS

| | | | | | |
|---|---|---|---|---|---|
| 2,923,119 | A | * | 2/1960 | Nifenecker | 57/1 R |
| 3,075,341 | A | * | 1/1963 | Latus | 57/1 R |
| 3,604,191 | A | * | 9/1971 | Jaeggli | 57/1 R |
| 3,977,168 | A | * | 8/1976 | Schewe | 57/1 R |
| 3,990,219 | A | * | 11/1976 | Schewe | 57/1 R |
| 4,036,000 | A | * | 7/1977 | Greive | 57/1 R |
| 4,204,391 | A | * | 5/1980 | Clayton et al. | 57/1 R |
| 4,332,129 | A | | 6/1982 | Schipper et al. | |
| 4,862,686 | A | * | 9/1989 | Stadele et al. | 57/1 R |
| 5,343,685 | A | * | 9/1994 | Burgermeister | 57/136 |

FOREIGN PATENT DOCUMENTS

| | | | |
|---|---|---|---|
| CH | 169001 | A | 5/1934 |
| DE | 2925668 | A1 | 1/1981 |
| DE | 3817679 | C1 | 11/1989 |
| DE | 10227944 | B3 | 2/2004 |
| DE | 102004041094 | A1 | 3/2006 |
| EP | 0384092 | B1 | 8/1990 |
| EP | 1375708 | A2 | 6/2003 |
| EP | 1357208 | A1 | 10/2003 |
| EP | 1737775 | | 7/2008 |
| WO | 2006021311 | A1 | 3/2006 |

* cited by examiner

*Primary Examiner* — Shaun R Hurley
(74) *Attorney, Agent, or Firm* — K&L Gates LLP

(57) ABSTRACT

Multi-station textile machine, in particular two-for-one-twisting or cabling machine, produces a high degree of flexibility with a simple structure by a respective double spindle unit (1) having a centrally arranged carrier (2), with a carrier (2) having a cross-member (20), which extends from one workstation to the other of the double spindle unit (1), supported by means of adjustable feet (26) on the ground, the carrier (2) furthermore having a centrally arranged hollow profile (21), which extends vertically from the cross-member (20), the hollow profile (21) being at least configured to receive a bobbin removal device (31, 33) and for fastening a winding device (3).

12 Claims, 7 Drawing Sheets

MULTI-STATION TEXTILE MACHINE, IN PARTICULAR TWO-FOR-ONE TWISTING OR CABLING MACHINE

CROSS-REFERENCE TO RELATED APPLICATIONS

This application claims priority from German Patent Application No. DE 10 2011 113 883.1, filed Sep. 22, 2011, herein fully incorporated by reference in its entirety.

FIELD OF THE INVENTION

The invention relates to a multi-station textile machine, in particular a two-for-one twisting or cabling machine, which comprises one or more double spindle units, which in each case have a frame, which carries the working and transporting elements and wherein the backs of the two workstations of the double spindle unit face one another.

BACKGROUND OF THE INVENTION

Conventional machines of the type described above, which are virtually 100% in use to date, are without exception multi-station machines. One workstation is arranged next to the other and the yarn feed devices and winding devices are driven by continuous shafts, which run lengthwise through the machine and are centrally driven by central electric motors arranged at the end.

The spindles are generally driven by belts or bands or else, in machines of a more recent design, are made to rotate by individual motors seated below or next to the spindles. In both cases, the drive or the feed and control take place centrally and collectively for all the spindles equally.

The machine frames are configured in double-sided sections in the mode of construction that is conventional nowadays, which contain about 8 to 16 spindles in each case and are sent to the customer disassembled, fully operable. They are assembled there with a central control and drive unit to form complete machines of up to about 40 meters in length, not infrequently with more than 200 workstations. These concepts and the high number of centrally provided spindles have meant that the entire production, transport and assembly costs can be apportioned very favourably to the individual workstations. This is therefore, overall, a very economical solution.

Machines of this type of design are, however, only suitable for the efficient production of mass produced goods. The flexibility required for smaller batches is not, on the other hand, ensured. Tasks requiring a high degree of flexibility can only be performed with high outlay for modification or with machines that are only used to part of their capacity, in other words relatively expensively.

A further drawback of centrally driven machines is that the efficiency of the machines drops dramatically in the case of machine malfunctions, because a large number of spindles are immediately affected during the machine stoppage. Each machine malfunction therefore becomes a relatively expensive event. Reference is made to German Patent Publication DE 29 25 668 A1 by way of example for a two-for-one twisting machine having the properties mentioned. Each so-called field, which consists of a large number of workstations, is arranged there between vertical machine stands and forms one section.

Proceeding from this, there has always been the requirement for more flexible machines. However, this generally failed owing to the comparatively high costs for producing the machines.

One possibility of achieving more flexibility is disclosed, for example, in European Patent Publication EP 1 737 775 A1. The solution described there still basically has the structure of a conventional multi-station machine, but individual drives and individual controls are now allocated to the individual spindles/workstations instead of central drives. This means that each workstation can be operated virtually self-sufficiently. However, the drawback in this solution clearly remains the retention of the central machine structure. In other words, despite higher costs with regard to the available number of spindles, only a limited flexibility is produced for the user. Solution proposals for transporting the bobbins away or for heat extraction remain completely open in European Patent Publication EP 1 737 775 A1.

A further step in the direction of unlimited flexibility is documented by European Patent Publication EP 1 357 208 A1. A self-sufficient individual workstation of a two-for-one twisting machine with precision winding-on is described here. A plurality of units thereof can still be joined to form a type of multi-station machine, but each position is nevertheless fully self-sufficient and is driven separately from the others. Any possibility of collecting the finished bobbins by a corresponding transporting device is also missing here. Only a one-sided machine is shown and described here, in which, however, any desired arrangement of the individual spindle units, also including a completely separate installation, is left open.

In order to be able to reduce the high costs for the obligatory air conditioning in textile businesses, conventional machines are furthermore frequently designed such that the machine frame toward the centre of the machine, forms a channel system, via which hot air can be extracted before the room is affected. A possibility of this type is neither provided nor structurally conceivable in the solution approach according to European Patent Publication EP 1 357 208 A1. A stand-alone machine frame standing independently for each position, inevitably leads to higher production costs. The stability of the individual spindle unit is limited by its base area. It is therefore necessary to take additional measures to increase the stability, said specification teaching that the individual spindle units are to be connected to one another.

It is furthermore known from European Patent Publication EP 0 384 092 B1, to produce double spindle units instead of individual spindles. These double spindle units have the advantage of greater stability and contain a removal system for the bobbins to be handled. The described double spindle units are seated in a base framework, which has six vertical struts spaced apart from one another, which are in turn connected to one another at the top and bottom by cross-members. The working elements of the two workstations are then fastened to this complex frame formed from a plurality of spatially arranged frameworks. The complex frame construction, as in conventional multi-station textile machines, only permits an extraordinarily limited variation of the dimensions of the working elements.

SUMMARY OF THE INVENTION

It is therefore the object of the present invention to propose a multi-station textile machine, which guarantees a high degree of flexibility and is simply constructed.

The invention is based on a multi-station textile machine, which comprises one or more double spindle units, which in each case have a frame, which carries the working and transporting elements and wherein the backs of the two workstations of the double spindle unit face one another. According to the invention, the respective double spindle unit has a centrally arranged carrier. The carrier has a cross-member, which extends from one workstation to the other of the double spindle unit and is supported by means of adjustable feet on the ground. The carrier furthermore has a centrally arranged hollow profile, which extends vertically from the cross-member and is configured to receive a bobbin removal device and for fastening a winding module.

The centrally arranged carrier, which forms the support construction for the two opposing workstations, is simply constructed and allows the fastening of components and component assemblies of the two workstations, for which there are virtually no restrictions with regard to their dimensioning. The structure and the use of a hollow profile, despite adapted bearing capacity, produce a low weight of the construction. The same support construction can be used for variously dimensioned workstations. Moreover, a minimum component variation and a cost saving are produced by multiple use of certain components. Compared to individual winding heads, the coupling of opposing working units is dispensed with. Owing to the special design of the hollow profile, it is simultaneously used to receive a bobbin transporting device, which, in particular when producing relatively heavy twisting bobbins, relieves the burden on the operating staff and can be installed without substantial additional outlay.

The invention has a number of advantageously features and contemplated embodiments.

The cross-member in an advantageous embodiment has at least one opening to which the suction device can be connected. In other words, the possibility is produced in a simple manner by the configuration of the vertical part of the carrier as a hollow profile with at least one opening of equipping the multi-station textile machine with a suction device, if necessary. The hot air being produced during production in the region of the workstation can be extracted without problems using a suction device of this type, which has a positive effect with regard to the air conditioning of the room in the relevant working hall of the customer.

The configuration of the winding device as a winding module has the advantage of rapid assembly including the exchange of the winding module for an alternative winding module, which can produce a different type of winding or else another dimension of the take-up bobbin. This consequently increases the flexibility, which is present in any case, of the multi-station textile machine.

In an advantageous embodiment of the housing of the winding module, the housing is connected to the hollow profile and the housing and the hollow profile have air passage openings that are aligned with one another. This has the advantage that owing to the aligned arrangement of air passage openings incorporated in the hollow profile and in the spindle module, an effective heat extraction can be ensured. In other words, the site of the production of heat can easily be effectively ameliorated through the hollow profile.

The provision of a control device of its own for each workstation ensures a further increase in the flexibility in the direction of a completely autonomous workstation.

A particularly simple solution is provided by the integration of the control unit into the winding module. For example, the necessity of data transmission into the winding module is dispensed with. The control unit in this case preferably has an operating unit, which allows a rapid and simple input or change of, for example, twisting parameters or working programs.

Although the multi-station textile machine according to the invention consists of individual double spindle units, it is obviously possible to communicate via an interface with a central control unit. The central control unit can transmit spindle-related data such as the desired value and working programs via this interface. The adjustment by the operator takes place at a central point here.

The decoupling of other workstations is assisted by separate drives of the working elements of the respective double spindle units.

If the double spindle units in each case have separately drivable transporting modules, which form transporting portion of the bobbin removal device, the limits for different transporting directions for the take-up bobbin produced can be varied as desired.

In a bobbin removal device common to a plurality of double spindle units, the limits for the transporting direction are fixed, but a common transporting device is less expensive. By changing the transporting direction, the possibility also exists here, however, of realising a plurality of transporting variants and thus implementing an additional sorting function.

If central supply elements are available for energy or else the activation of the double spindle units, these should have resilient properties, whereby a vibration transmission between the double spindle units is substantially suppressed. Separate connection elements, between the double spindle units are also conceivable, which should then also have resilient properties, however.

It can easily be seen that with a dimensioning of working elements or modules going beyond a certain measure, this fact can be taken into account purely by the adjacent double spindle units being spaced apart with respect to one another. Basically, it is always possible, to also exchange double spindle units, to vary the number of double spindle units forming the multi-station textile machine or to adapt it to the spatial circumstances.

BRIEF DESCRIPTION OF THE DRAWINGS

The invention will be described in more detail below with the aid of embodiments shown in the drawings, in which.

DETAILED DESCRIPTION OF THE PREFERRED EMBODIMENTS

Figure 1:
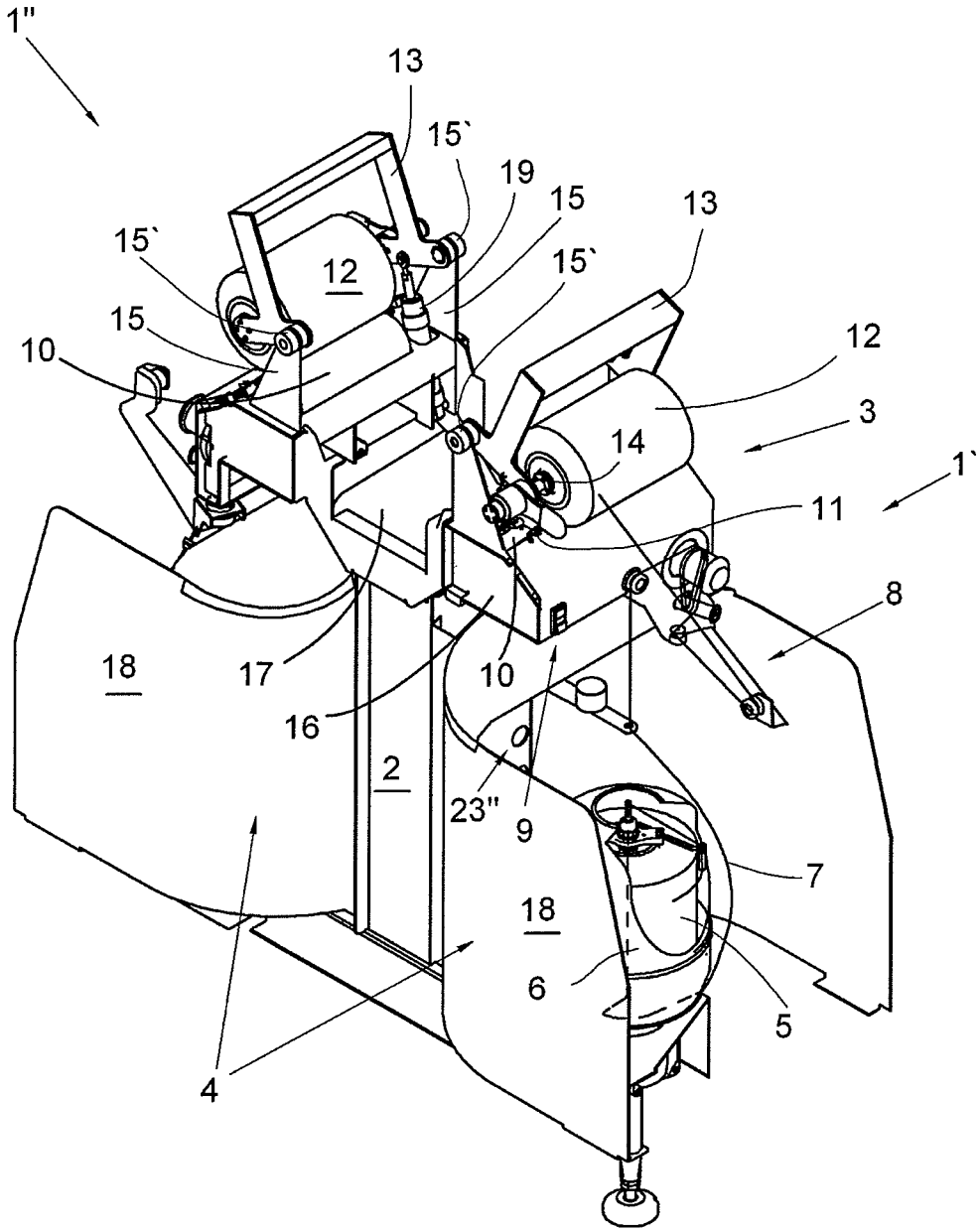
FIG. 1 shows a perspective view of a double spindle unit according to the invention.

The double spindle unit 1 shown in FIG. 1 has a carrier 2, which is arranged centrally and contains all the working elements of the workstation 1', 1" facing one another with their backs, as well as a transporting module 17. The two workstations 1' and 1" are two-for-one twisting devices in the embodiment.

Figure 2:
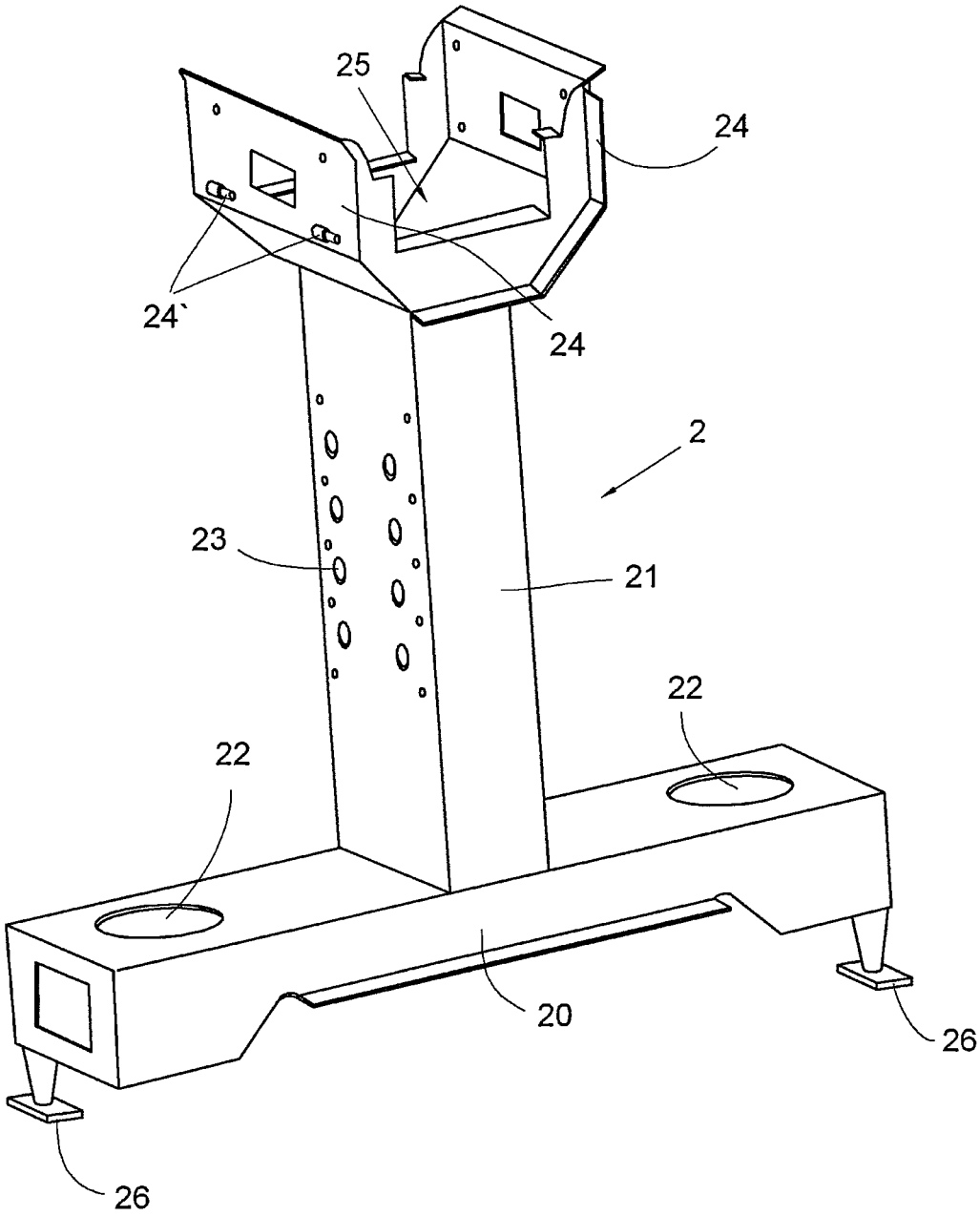
FIG. 2 shows a carrier of a double spindle unit according to the invention in a perspective view.

The carrier 2, shown in more detail in FIG. 2, has a cross-member 20, which is supported by adjustable feet 26 on the ground. For further stabilisation, in particular when a double spindle unit of this type stands alone, four feet 26 should be used or the feet should have greater standing areas. In any case, a dimensioning should be provided such that adequate stability of the double spindle unit is ensured. A hollow profile 21, which, at its upper end, has assembly jaws 24 for the winding module 3 and a receiver 25 for a transporting module 17, extends vertically from the cross-member 20. The openings 22 in the cross-member 20 are used to receive individual drives of the spindle module 4.

Furthermore, the hollow profile 21 may be provided with an opening, not shown, which is aligned with a corresponding opening in the cross-member 20. The connection of a suction device for removing heat being produced during twisting becomes possible by means of a configuration of this type. in order to be able to extract the heated air as close as possible to the site where it is produced, the hollow profile 21 may also have cooling openings 23, which align with openings 23' in an assembly plate 27 and openings 23" in the housing 18 of a spindle module 4.

Figure 3:
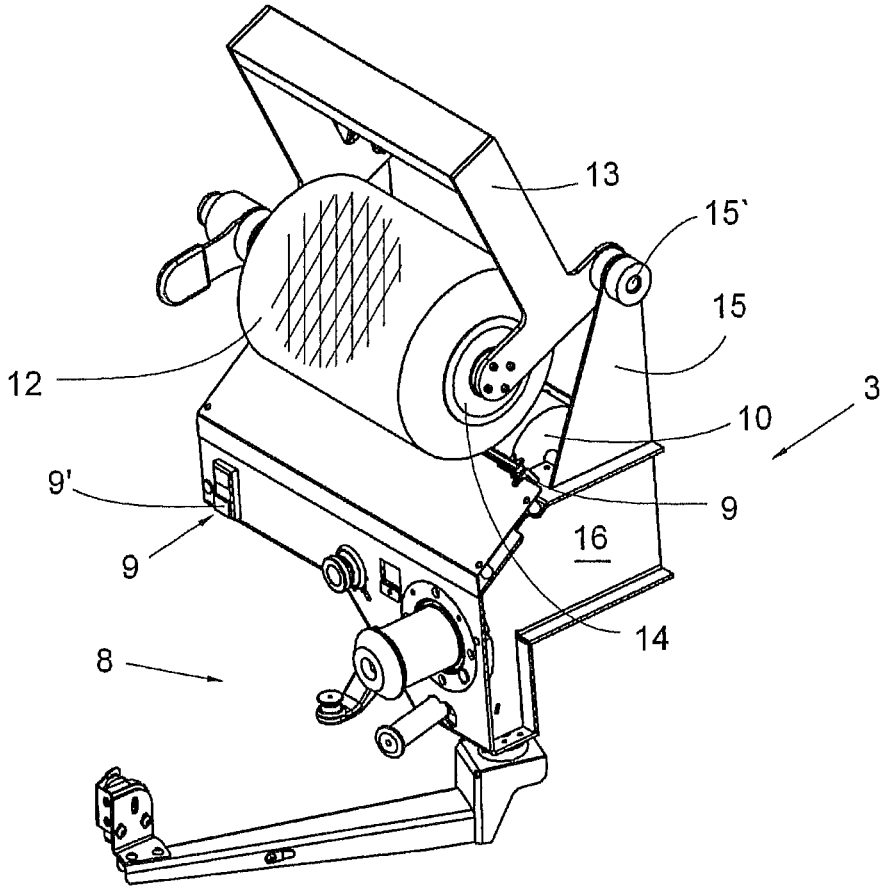
FIG. 3 shows a winding module in a perspective view.
Figure 4:
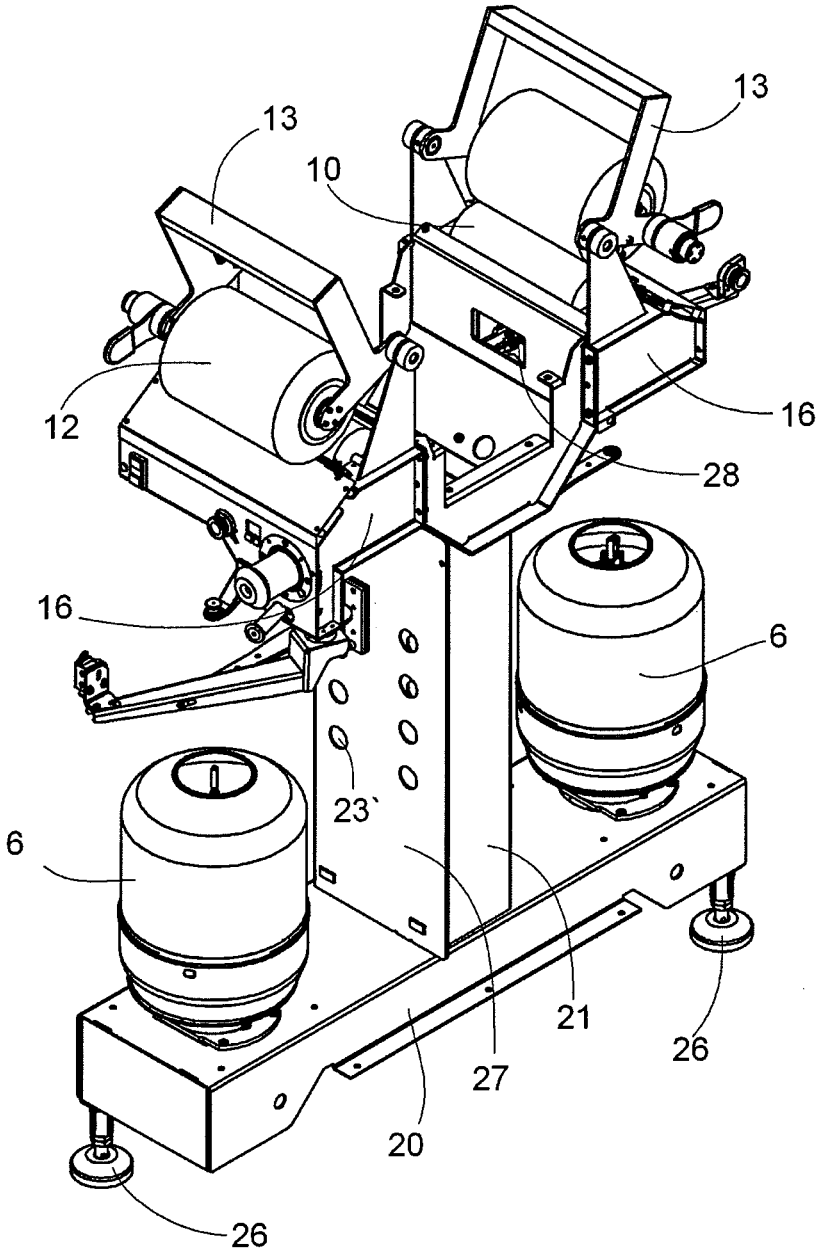
FIG. 4 shows a double spindle unit according to the invention, partially assembled.
Figure 5:
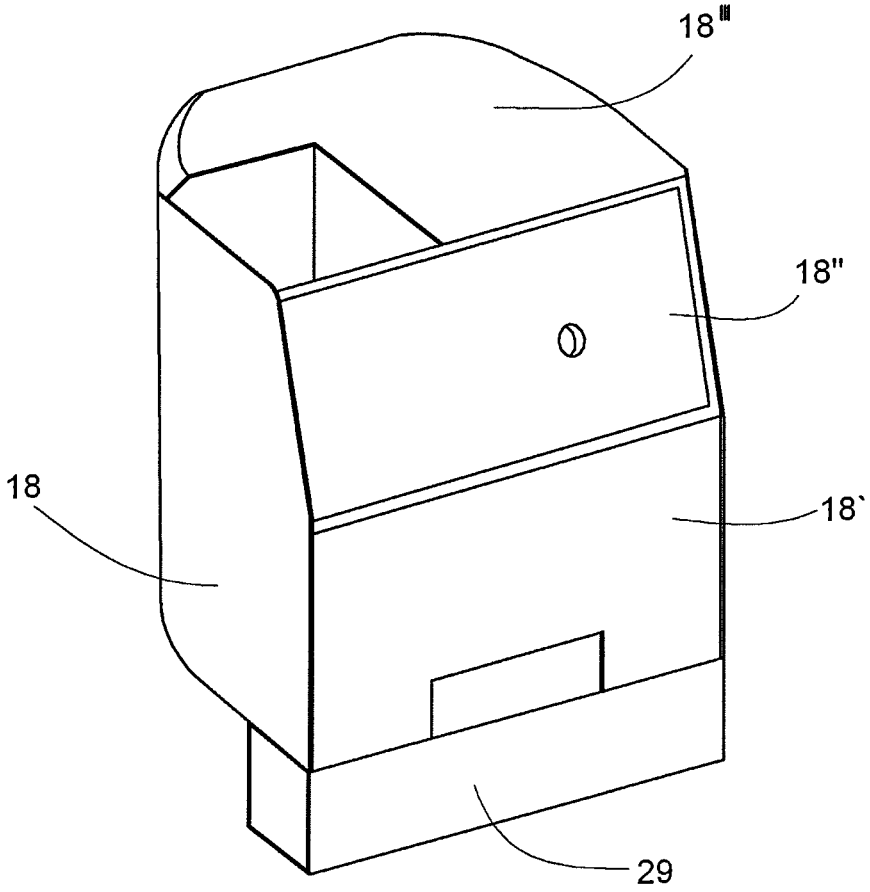
FIG. 5 shows the housing of a spindle unit.

Of the workstation 1', FIG. 1 shows the spindle module 4 with the delivery bobbin 5, bobbin pot 6 and balloon yarn 7 as well as the surrounding housing 18. The housing 18 is connected by an assembly plate 27 (FIG. 4) to the hollow profile 21. The housing 18, at the front, has a front plate 18', a generally transparent, foldable cover part 18" and a covering 18'" (FIG. 5). The winding module 3 arranged thereabove, which is shown in more detail in FIG. 3, has yarn guide and transporting members 8, a friction drive 10 and a yarn guide 11. The take-up bobbin 12 is mounted by means of bobbin plates 14 in the pivotable creel 13, which is in turn held by a bearing 15' in bearing jaws 15 of the winding module 3.

A control unit 9 having operating elements 9' is arranged in the winding box 16 of the winding module 3. A framework damper 19 is in each case articulated to the creel 13 and ensures a uniform pressing pressure and, simultaneously, a damping of the vibrational movement during winding. The transporting module 17 is provided for removing the completed take-up bobbins after they have been changed. This transporting module 17 forms a transporting portion with a transporting belt 31 particular to the transporting module or a transporting belt 33 comprising a plurality of double spindle units 1 (FIG. 7). Whether a double spindle-related transporting belt 31 or a transporting belt 33 comprising a plurality of double spindle units is used depends on the desired flexibility of the removal of the take-up bobbins 12. While a higher degree of flexibility is provided with individual transporting portions with transporting belts 31 according to FIG. 6, the construction outlay required for the removal is reduced with a longer transporting belt 33. However, in the latter case, the possibilities for varying the limits between different transporting directions for the take-up bobbins 12 are fixed.

In the machine shown in FIG. 7, a disposal station 34 with a removal position is also shown, to which the completed take-up bobbins 12 are transported in order to be able to be transferred from there, for example by means of a lift to a suspended conveyor or to a pallet.

Figure 6:
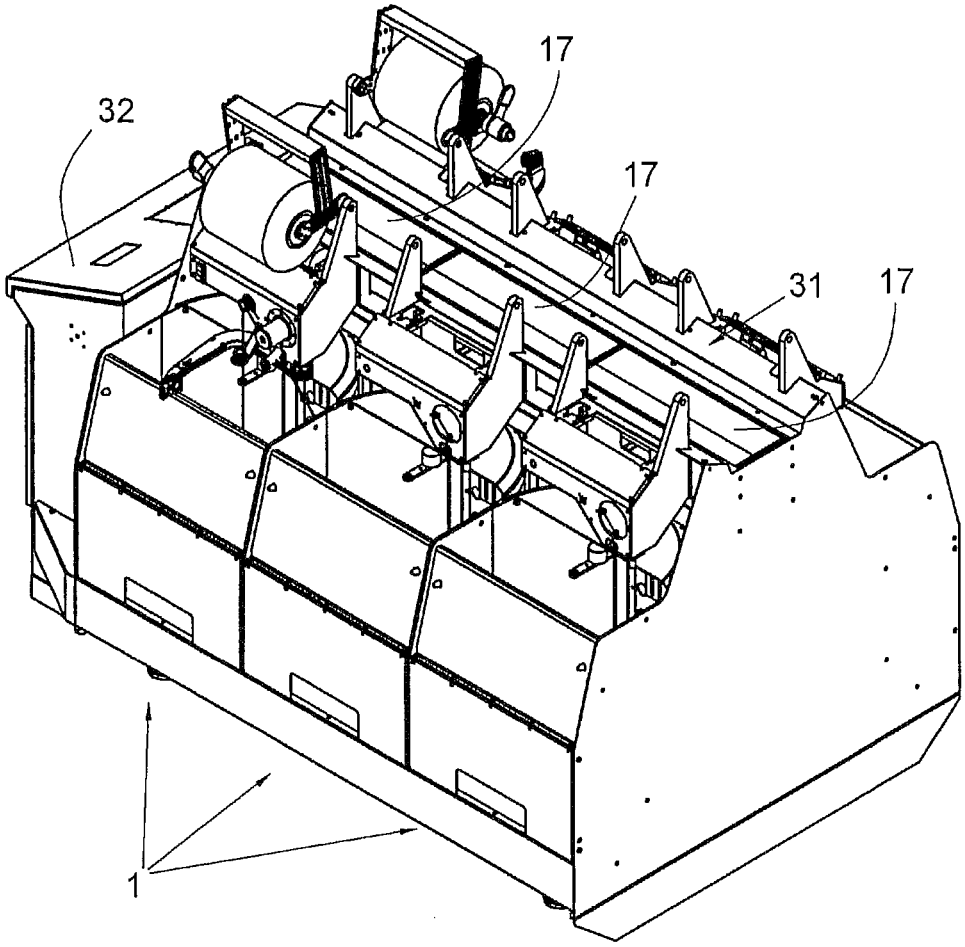
FIG. 6 shows a perspective view of a multi-station textile machine and FIG. 7 shows a further perspective view of a multi-station textile machine.
Figure 7:
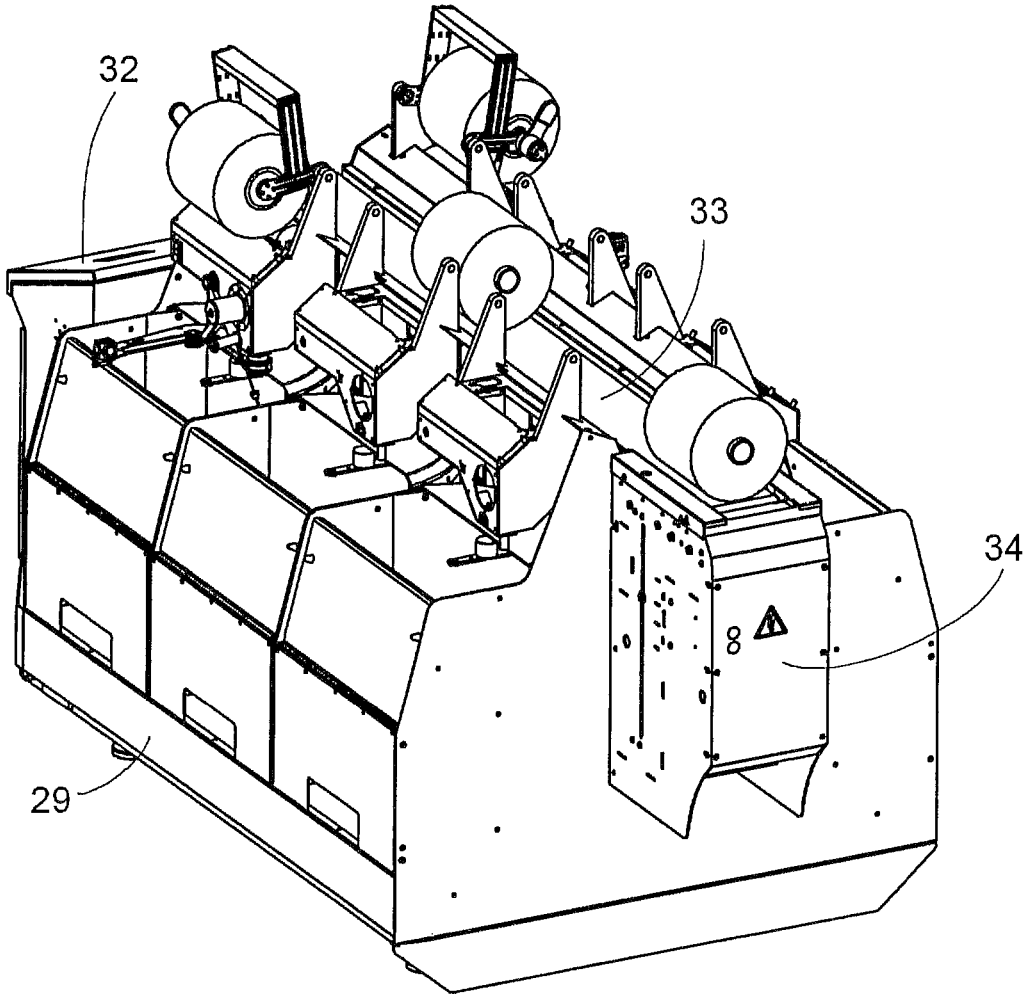

As can be seen in FIGS. 6 and 7, the arrangement of double spindle units 1 is limited on both sides by terminating plates, which then correspond with corresponding common devices 32 or 34.

With the machines shown in FIGS. 6 and 7, a central control device 32 is shown, which, for example, contains a central energy supply or else optionally a control device, with which the control units 9 particular to the workstation can be addressed. Thus, for example, corresponding inputs for all the workstations 1', 1" or for groups of these workstations can be adjusted in the central control device 32.

The winding modules 3 are attached as a whole to the assembly jaws 24 of the carrier 2 and can easily be exchanged. This does not only relate to the exchange in the case of a defect, but also an exchange for a different winding module, with which bobbins of other dimensions or with other winding methods or a greatly differing yarn material can be replaced.

Hinge-like holders 24', after the release of upper screw connections, not shown, to the winding module 3, allow the pivoting of the winding module downward into the region of the housing 18 of the spindle module 4, so the transporting volume of the double spindle unit 1 can be substantially reduced.

As can be seen from FIGS. 5 and 7, a supply channel 29 is also present, in which, for example, corresponding supply lines are laid. With a flexible design of this supply channel, the transmission of vibrational movements from one workstation to the other is effectively prevented. Moreover, the length of the respective supply channel 29 can be adapted to the flexible machine length. Supply lines coming from this supply channel are, for example, guided upwardly through the hollow profile and open via a supply opening 28 into the winding module with the control unit 9. Not shown here, but also obviously possible in the framework of the invention, is the arrangement of spacers between the individual double spindle units 1. The dimensions of these spacers optionally depend on what dimension the corresponding working elements of the spindles have. Thus, it is certainly possible to increase the extent of the working elements with a given construction, which is readily possible by means of the carrier 2 arranged centrally according to the invention. Overall, this produces a considerable improvement in the flexibility with regard to the configuration of a machine.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Multi-station two-for-one-twisting or cabling textile machine, which comprises one or more double spindle units, which, in each case, have a frame, which carries the working and transporting elements and wherein the backs of the two workstations of the double spindle unit face one another, characterized in that the respective double spindle unit (1) has a centrally arranged carrier (2), in that the carrier (2) has a cross-member (20), which extends from one workstation to the other of the double spindle unit (1) and is supported by means of adjustable feet (26) on the ground, in that the carrier (2) furthermore has a centrally arranged hollow profile (21), which extends vertically from the cross-member (20) and in that the hollow profile (21) is at least configured to receive a bobbin removal device (31, 33) and for fastening a winding device (3).

2. Multi-station textile machine according to claim 1, characterized in that the cross-member (20) has at least one opening, to which a suction device can be connected.

3. Multi-station textile machine according to claim 1, characterized in that the winding device (3) is configured as a winding module.

4. Multi-station textile machine according to claim 1, characterized in that the housing (18) of a spindle module (4) is connected to the hollow profile (21) and in that the housing (18) and the hollow profile (21) have air passage openings (23, 23', 23") that are aligned with one another.

5. Multi-station textile machine according to claim 1, characterized in that each double spindle unit (1) has a control unit (9).

6. Multi-station textile machine according to claim 5, characterized in that the control unit (9) is integrated in the winding module (3).

7. Multi-station textile machine according to claim 5, characterized in that the control unit (9) has an operating unit (9').

8. Multi-station textile machine according to claim 5, characterized in that the control unit (9) has an interface for communicating with a central control unit (32).

9. Multi-station textile machine according to claim 7, characterized in that the working elements of the respective double spindle units (1) have separate drives and the double spindle units (1) can be operated autonomously by means of the associated control device (9).

10. Multi-station textile machine according to claim 1, characterized in that the double spindle units (1) in each case have a separately operable transporting module (17), which forms a transporting portion of the bobbin removal device (31).

11. Multi-station textile machine according to claim 1, characterized in that a plurality of double spindle units (1) are provided with a common bobbin removal device (33), the end double spindle units with respect to the transporting portion formed thereby being provided with the required deflection devices for a continuous traction means (33).

12. Multi-station textile machine according to claim 1, characterized further by separate or continuous connection elements (29) bridging the double spindle units (1) that have resilient properties to suppress a vibration transmission.

* * * * *